US006244438B1

(12) United States Patent
Weinmeier

(10) Patent No.: US 6,244,438 B1
(45) Date of Patent: Jun. 12, 2001

(54) GOLF CLUB HOLDER

(76) Inventor: Robert J. Weinmeier, 520 Washington Blvd., Suite 281, Marina Del Rey, CA (US) 90292

( * ) Notice: Subject to any disclaimer, the term of this patent is extended or adjusted under 35 U.S.C. 154(b) by 0 days.

(21) Appl. No.: 09/148,297

(22) Filed: Sep. 4, 1998

Related U.S. Application Data

(60) Provisional application No. 60/057,951, filed on Sep. 5, 1997.

(51) Int. Cl.[7] ..... A63B 55/04

(52) U.S. Cl. ..... 206/315.6; 206/315.2; 211/70.2

(58) Field of Search ..... 248/229.1, 229.14, 248/96; D3/320; 211/70.2; 206/315.2, 315.3, 315.6, 315.7

(56) References Cited

U.S. PATENT DOCUMENTS

D. 384,503 * 10/1997 Kyrwood ..... D3/320
4,960,212 * 10/1990 Wu ..... 211/70.2
5,383,555 * 1/1995 Weinmeier ..... 206/315.6
5,511,660 * 4/1996 Yamada ..... 206/315.6
5,617,951 * 4/1997 Wick ..... 206/315.6

* cited by examiner

*Primary Examiner*—Leslie A. Braun
*Assistant Examiner*—Gwendolyn Baxter
(74) *Attorney, Agent, or Firm*—Koppel & Jacobs; Michael J. Ram

(57) ABSTRACT

A universal golf club securer and organizer for securing golf clubs in a fixed position in a golf bag which consists of a series of individual resilient clips having adjustable positions on a support bar thereby compensating for the width of any club in a set of golf clubs. The support bar is attached to a golf bag by means of a rod and clamp system which is adjustable to the height of any set of golf clubs.

3 Claims, 3 Drawing Sheets

GOLF CLUB HOLDER

This invention claims priority of Provision Application Ser. No. 60/057,951 filed Sep. 5, 1997.

In accordance with the present invention, a universal golf club securer and organizer includes two singular support bars upon which are attached numerous individual resilient clips for securing the head of a single golf club. Each golf club head securer is made of a strong yet resilient material which both holds the golf club firmly in place and allows easy insertion and extraction of a golf club head. Further, the golf club head securer is molded to fit any ironhead golf club. The minor variations between sets of golf clubs in size and contour are accommodated by the flexible nature of the resilient securing device.

In the preferred embodiment of the invention, the two singular support bars are made of a relatively stiff material which has been molded to be attached to a bag at an angle of approximately fifteen degrees from front to back. In this configuration, when the golf clubs are inserted into their proper securing device, the golfer is able to see each club at a glance.

A separate feature, a central holding unit made of the same relatively stiff material as the frame has other resilient clips which may be used to hold additional golf clubs such as the woods and the putter. This arrangement protects the woods and the putter from damage and keeps the golf club bag in balance.

Another aspect of the present invention includes a system designed to allow attachment of the frame of the club holder to golf club bags of varying sizes. Additionally, the system is adjustable to the height of any set of golf clubs.

The preferred embodiment of the invention may also include the following additional features:

1. The support bars and the securing devices may come in a variety of different colors.
2. The support bars and the securing devices may be integral with a golf club bag as one unit, or readily removable from the bag and transferred to a second bag.
3. The securing devices may have numbers imprinted thereon which correspond to the specific golf club number.
4. The frames may be made in different sizes and shapes to accommodate non-standard golf club bag openings, including circular.

Advantages of the present invention include the fact the clubs are secured and held in a manner that protects the clubs both during usage and during travel. Since the clubs are suspended either longitudinally across the bag mouth or in the separate central holder, the bag is always kept in balance. Another advantage is the organization of the clubs which the invention provides. This organization, combined with the physical angle-like form, allows for easy location and easy inventory of the clubs. Further, since each clubhead is protected and not allowed to move freely or rotate in the bag, the invention reduces or eliminates the noise typically made by clubs rattling and banging each other when carried in a golf bag.

Other objects, features and advantages of the present invention will become apparent from a consideration of the following detailed description and from the accompanying drawings.

Figure 3A:
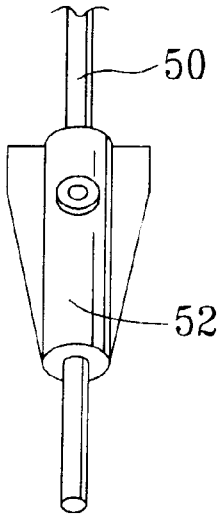
Figure 3B:
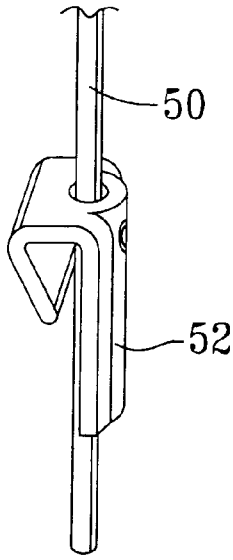
Figure 4:
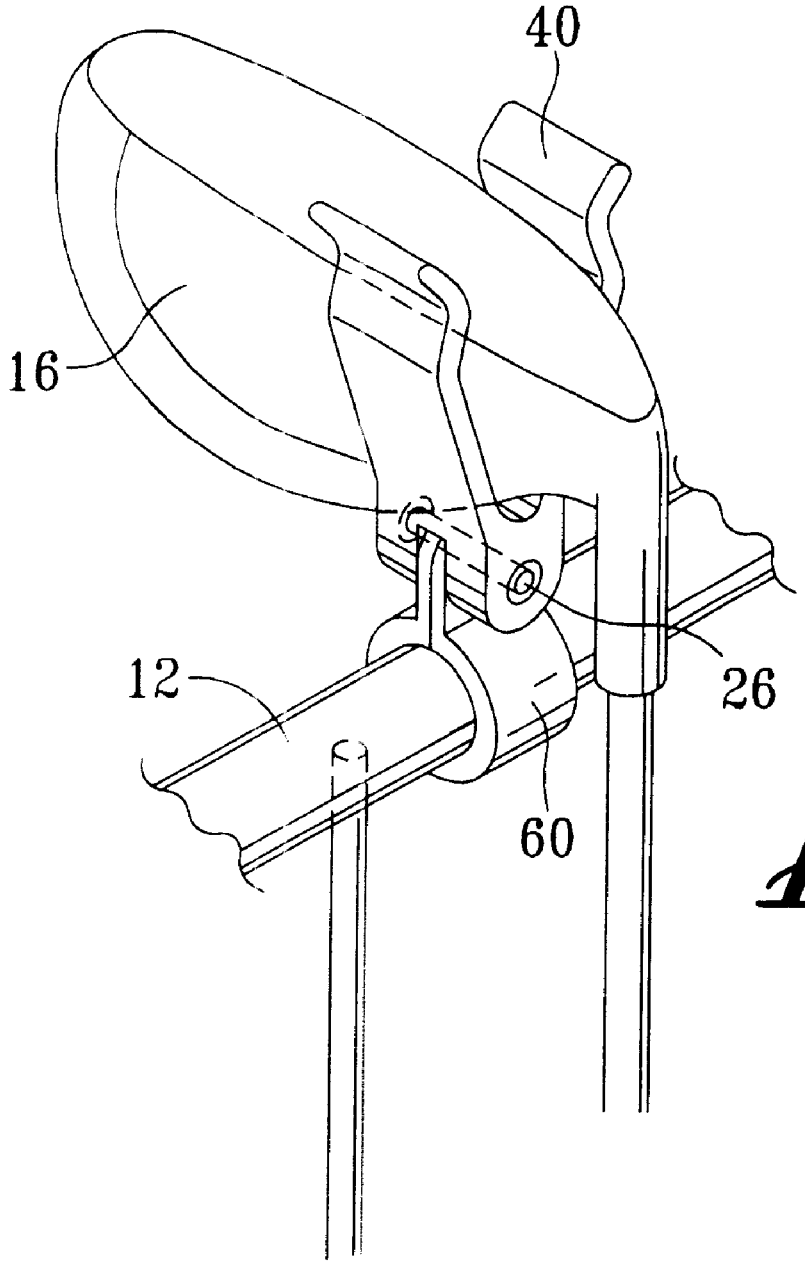

FIG. 3*a* is a form perspective view and FIG. 3*b* is a side perspective view of the rod and clamp FIG. 4 is a perspective view of the support bar, support bar clip and club head securer adjusted to receive an angled iron.

DETAILED DESCRIPTION OF THE PREFERRED EMBODIMENT

Figure 1:
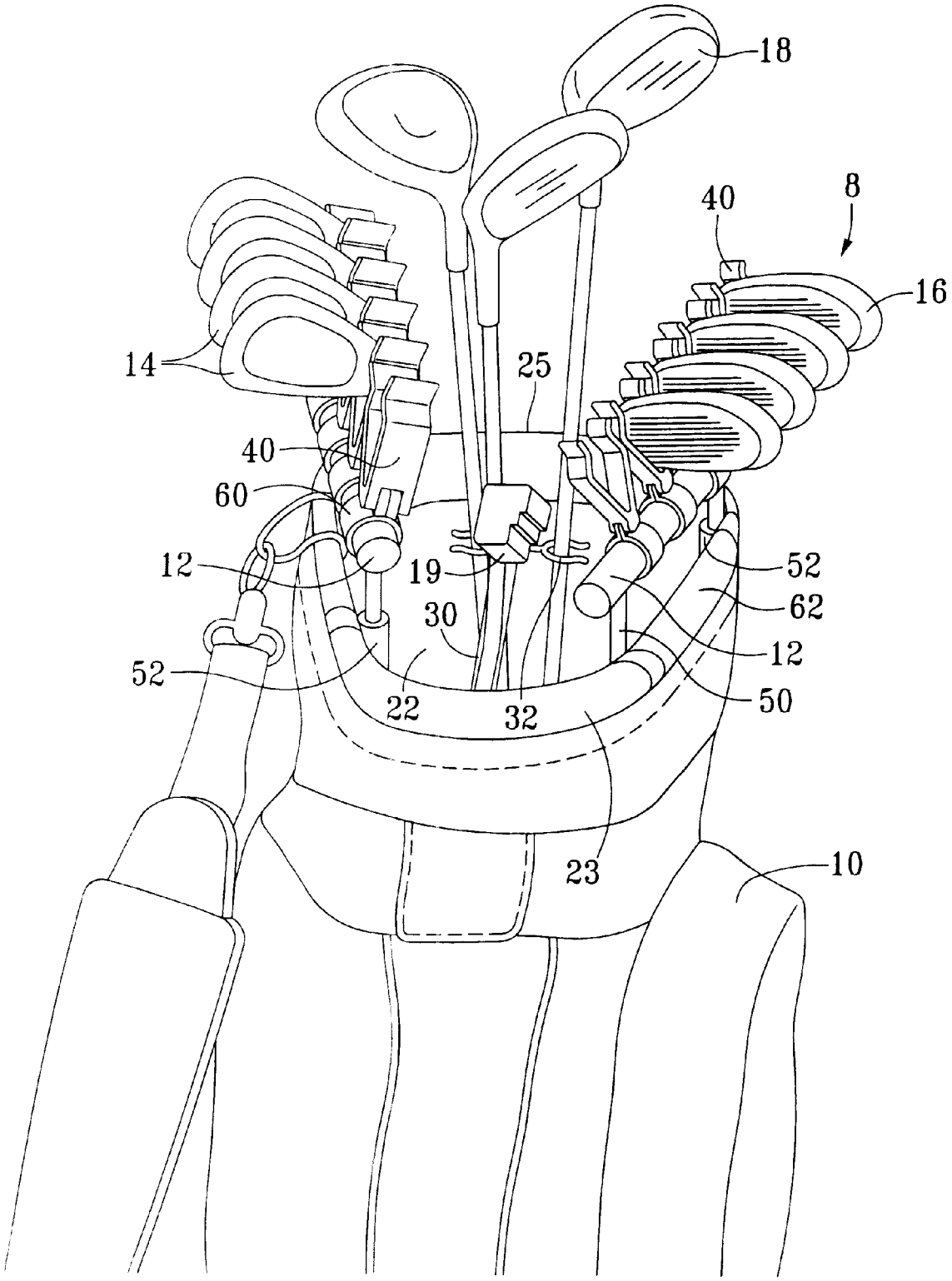
FIG. 1 is a perspective view of a golf bag embodying the device of the present invention.

Referring more particularly to the drawings, FIG. 1 is a depiction of a universal golf club securer and organizer 8 attached by means of rods 50 and clamps 52 to a support bar 12 of the golf bag 10. Placing the shafts of the irons into the inner recesses of the golf club bag 10 and the heads of the golf club irons 16 into the golf club head securer 40, the irons 14 are neatly spaced longitudinally from front to back of the golf club bag so that the irons 14 are held securely in place at all times.

Securing the clubs in place has several advantages. First, if the golf bag 10 is upset or used for long distance transportation, the clubs will remain secure and in place. Second, the club heads are protected from scratching and chipping. Third, the clubs 14 are easy to find and return to the same location because each has a proper position in the universal golf club securer and organizer 8. This also helps with keeping a constant inventory of the clubs and reduces the likelihood that clubs will be lost.

The support bars 12 of the universal golf club securer and organizer 8, as can be seen from FIG. 1 in a preferred embodiment, are straight tubular rods with rounded ends. Each support rod has several golf club head securers 40 mounted upon it. The head securers are attached to the support rod by the support rod clip 60 which slides along the support bar 12 allowing various configurations of the head securers. The ultimate formation of the golf club head securers 40 allows the user to see all the clubs at one time. Additionally, this configuration puts the heads in a longitudinal and angular formation which is particularly attractive.

Located in the center of the bag between the two separate singular support bars is a central inner holder 30 with clips 32 into which golf clubs such as the woods 18 and the putter 19 may be inserted. FIG. 1 shows the golf club woods 18 held in the clips 32 of the central inner holder 30 and extending above the irons 16.

FIG. 1 is a perspective view of the universal golf club securer and organizer 8 in place in the golf bag 10 and containing a set of golf clubs 14, 18, and 19. The irons 14 are held in place by contoured-like securers 40 longitudinally across the golf bag 10. The woods 18 and putter 19 are situated within the clips 32 of the separate central inner holder 30 which is mounted to extend across the central opening 22 of the golf bag 10. The typical diameter or width of a rim of a golf bag opening 62 may be approximately eight to ten inches. By using several rods 50 and clamps 52 (as best seen in FIG. 3) the two singular support bars may be used to fit any standard round or square shaped or sized golf bag 10. The rods 50 and lamps 52 will be discussed in greater detail in conjunction with FIG. 3.

The singular support bars 12 of the golf club securer and organizer is made of a relatively stiff material. In its preferred embodiment, the two singular support bars is molded out of a firm plastic or rubber material, other materials which could be effective used to make a frame include, for example, a lightweight metal or fiberglass. These materials are merely examples and are not intended to limit the scope of the invention.

The two singular support bars 12 in the preferred embodiment are approximately parallel and define a central opening 22. However, the two singular support bars 12 may be angled symmetrically toward a lower portion 23 and be spaced further apart at an upper portion 25 of the golf bag 10.

Figure 2:
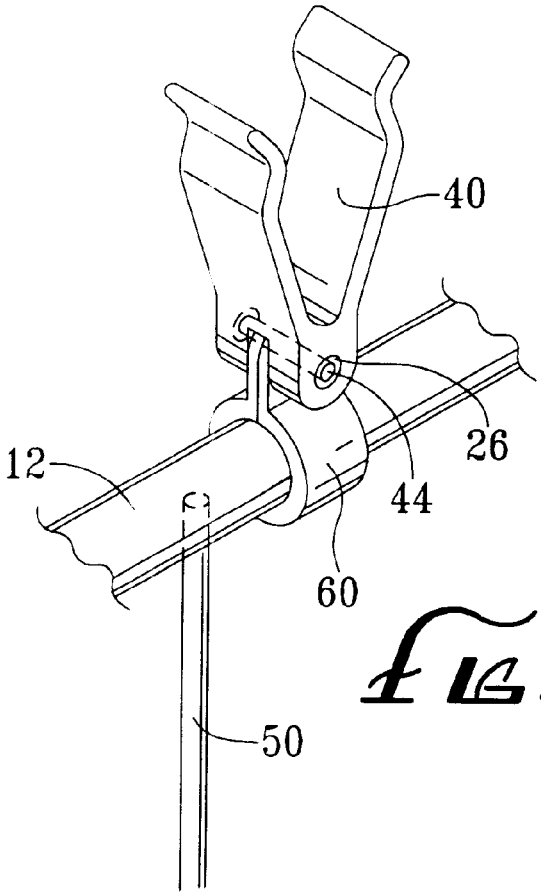
FIG. 2 is a perspective view of the support bar, support bar clip and clubhead securers.

Each support bar 12 has at least one golf club head securer 40 mounted upon it. By inserting the locking device 44 through the bore 26 (as best seen in FIG. 2) the golf club head securer 40 is fastened to the support bar clip 60. Alternatively, other methods of mounting, such as glues or mating recesses, known to those skilled in the art, could be used by way of illustrative examples.

Located within or extending across the central opening 22 is a central inner holder 30. As shown, the central inner holder is attached to the lower portion 23 and upper portion 25 of the golf bag 10. The central inner holder 30 is preferably formed of the same stiff material as the support bar 12. The central inner holder 30 and the support bar 12 may be a single unit or may be formed separately and secured together.

The support bar 12 is attached to the rim of a golf bag 22 by a series of rods 50 and clamps 52. In the preferred embodiment, the rods 50 (as best seen in FIG. 3) are made of a sturdy material such as steel or aluminum. The rods consist of two longitudinal portions. The portions of the rod should be long enough to allow for both the varied width of the openings of a golf bag 10 and for the varying heights of golf club sets. A set of essentially flattened hook-shape clamps 52 are provided to secure the rod 50 to the rim of the golf club bag 10. The clamps are made of a sturdy high-strength metallic material such as engineered plastic, steel, or aluminum.

This rod 50 and clamp 52 (as best seen in FIG. 3) system of joining the golf club securer and organizer 8 to the golf bag 10 is only meant to be exemplary. Another method could involve the use of extension rings in which either several rings of uniform size or rings of the height desired are provided to be secured between the frame 20 and the rim of the golf bag 10. In addition, the frame 20 could be permanently attached to the golf bag 10.

FIG. 4 is a longitudinal cross-sectional view of a golf club head securer 40 and the adjacent portion of the support bar 12. The securer is made of a resilient material which, in the preferred embodiment, is a plastic or rubber material. The upper portion of the securer 40 is an opening of the general shape of the head of a golf club iron 16. A golf club iron is pressed into the golf club head securer 40 from above, and is held in place by the spring action of the resilient golf club head securer. The golf club head securer may be rotatably attached to the support bar clip 60 which then is attached to the support bar 10 so that the angle of the golf club head securer with respect to the support bar can be changed to allow for differences in angles in the heads of golf club irons. A bolt, screw, or other fastener 44 is inserted through the opening 26 in the base of the support bar clip 60 for rotatably attaching the clip to the support bar. The support bar clip 60 with the golf club head securer 40 may be adjusted along the support bar 12 to adequately accommodate various size golf club irons in succession.

In conclusion, it is to be understood that the present invention is not to be limited to that precisely as described herein-above and as shown in the accompanying drawings. More specifically, the support bars could take shapes other than straight (such as curved or bowed) in order to accommodate various styles of golf club bags. Further, the club holders can be of various colors or numbered for easier club identification. The materials discussed are meant to be exemplary and could be exchanged with any other material suitable for the intended purpose. Numbering on the holders corresponding to the numbers of the specific golf club could be added to the exterior or top surface of the holders. Also the contour of the fingers of the securers can be modified to hold woods or the putter or separate adapters specifically designed to hold clubs or items other than irons can also be mounted to the support bars. Accordingly, the present invention is not limited to the arrangements precisely as shown and described herein-above.

I claim:

1. A golf club iron organizer and securing assembly attachable to the top of a golf club bag for holding golf club irons in an organized manner comprising at least two securing assemblies, each securing assembly having multiple golf club head securers moveably attached to a single support bar, each support bar having means attached thereto to removably mount the securing assembly at two spaced apart locations on the upper edge of a golf bag, each securing assembly, once mounted, extendable over an upper opening of the golf club bag so as to position the shafts of the golf clubs irons secured thereby extendable into the golf bag with the heads of the golf club irons adapted to be held by the golf club head securers at an angle to and elevated above the upper opening of the golf bag, the angle of the club head securers being adjustable so the golf club shafts are adapted to hang vertically in the bag, each of said multiple golf club head securers comprising first and second upward extending fingers joined at a lower end thereof and spaced apart at an upper end thereof, the area between each first and second finger being a V-shape adapted to receive the head of a golf club iron, each golf club head securer including a swivel means at a point of attachment to the support bar so that the head securer can be oriented, when holding a golf club head, to suspend the golf club shaft in a desired orientation and location within the upper opening of the golf bag and to other golf clubs also suspended, the means attached to the support bar for mounting the securing assembly to the upper edge of a golf bag optionally including an adjustment means to allow independent elevation of each end of the support bars a desired distance above said upper edge of the golf bag.

2. A golf club organizer and securing assembly attachable to a golf club bag for holding golf clubs comprising at least a first club holder and a second club holder adapted to hold several golf club irons and a central inner holder adapted to hold golf club woods and a putter wherein, each of the first club holder and the second club holder comprising multiple golf club head securers, the multiple golf club head securers being attached to a single support bar, each support bar with golf club head securers constituting a securing assembly, the support bar having means attached thereto for removably mounting at two spaced apart locations on the upper edge of a golf bag, the securing assembly, once mounted, extendable over an upper opening of a golf club bag so as to position the shafts of the golf clubs irons extendable into the golf bag with the heads of the golf club irons adapted to be held at an elevated angle to the upper opening of the golf bag, each golf club head securer comprising first and second upward extending fingers joined at a lower end thereof and spaced apart at an upper end thereof, the area between the first and second finger being of a V-shape and adapted to receive the head of a golf club iron, each golf club head securer including a swivel means at a point of attachment to the support bar so that the head securer can be oriented, when holding a golf club head, to suspend the golf club shaft in a desired orientation and location within the upper opening of the golf bag and to other golf clubs so suspended, the means attached to the support bar for mounting the securing assembly to the upper edge of a golf bag optionally including adjustment means to allow independent elevation of each end of the support bar a desired distance above said upper edge of the golf bag, the central inner holder positioned in a central opening in the upper portion of the golf bag separate from the first and second securing assembly, and being removably mountable therein, the central inner holder including means to receive the shaft of the golf club woods and putter, the golf club head securers on the first club holder adapted to hold several golf club irons and the central inner holder adapted to hold golf club woods and putter all functioning in combination to hold multiple golf clubs of different sizes and different uses in the golf bag, wherein each club is spaced from the other clubs and all clubs are held in substantially parallel orientation with the heads of all of the clubs oriented so that each head is readily visible to a person desiring to select a club for use.

3. The golf club organizer and securing assembly of claim 2 including two club holder, each for holding several golf club irons.

* * * * *